US006772968B2

(12) United States Patent
Jara-Almonte et al.

(10) Patent No.: US 6,772,968 B2
(45) Date of Patent: Aug. 10, 2004

(54) WASTE LINE CONNECTOR ASSEMBLY FOR FOOD WASTE DISPOSER

(75) Inventors: Cynthia C Jara-Almonte, Kenosh, WI (US); Thomas R Berger, Racine, WI (US); Jeff P Culver, Sturtevant, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/300,219

(22) Filed: Nov. 20, 2002

(65) Prior Publication Data

US 2003/0094521 A1 May 22, 2003

Related U.S. Application Data

(60) Provisional application No. 60/332,150, filed on Nov. 21, 2001.

(51) Int. Cl.[7] ..... B02C 23/36
(52) U.S. Cl. ..... 241/46.013; 241/46.014
(58) Field of Search ..... 241/46.012, 46.013, 241/46.014, 46.016; 285/48, 49, 148.14, 148.17, 239, 240, 252

(56) References Cited

U.S. PATENT DOCUMENTS

| | | | | |
|---|---|---|---|---|
| 3,801,998 A | * | 4/1974 | Macias | 4/629 |
| 3,857,589 A | | 12/1974 | Oostnbrink | 285/110 |
| 4,036,512 A | | 7/1977 | Francis | 285/111 |
| 5,312,138 A | * | 5/1994 | Patera et al. | 285/12 |
| 5,314,214 A | * | 5/1994 | Highlen et al. | 285/233 |
| 5,924,635 A | | 7/1999 | Onodera et al. | 241/46.015 |
| 6,299,214 B1 | * | 10/2001 | Li et al. | 285/49 |
| 2002/0134615 A1 | | 9/2002 | Herreman et al. | 181/290 |
| 2002/0135180 A1 | | 9/2002 | Ando et al. | 285/239 |

FOREIGN PATENT DOCUMENTS

| | | | |
|---|---|---|---|
| BE | 878 181 | 12/1979 | H02G/3/22 |
| DE | 959 244 | 2/1957 | B02C/18/42 |
| EP | 1 048 884 | 11/2000 | F16L/37/098 |
| FR | 2 054 733 | 5/1971 | F16L/27/107 |
| GB | 1 209 195 | 10/1970 | F16L/51/02 |
| GB | 2 044 379 | 10/1980 | F16L/47/10 |

OTHER PUBLICATIONS

Patent Abstract of Japan for Publication No. 05008285, Jan. 19, 1993, 1–pg.
International Search Report dated Apr. 8, 2003 for the related pending PCT application PCT/IB02/04862, 4–pgs.
Translation of DE 959 244 from p. 2, lines 86–120 and claim 6, 1–pg.

* cited by examiner

*Primary Examiner*—Ed Tolan
(74) *Attorney, Agent, or Firm*—Howrey Simon Arnold & White LLP

(57) ABSTRACT

A waste line connector assembly for connecting a food waste disposer to a waste line is disclosed. The connector assembly isolates vibrational forces of the waste disposer from the waste line caused during the operation of the waste disposer. The connector assembly includes a flexible isolation coupler. The flexible isolation coupler has a flexible portion for absorbing the vibrational forces of the waste disposer. The flexible isolation coupler may be directly coupled to the discharge outlet of the waste disposer or to the waste line. The flexible isolation coupler may also be attached between two tubular tailpipes, which are coupled to the discharge outlet of the waste disposer or to the waste line.

37 Claims, 9 Drawing Sheets

WASTE LINE CONNECTOR ASSEMBLY FOR FOOD WASTE DISPOSER

CROSS-REFERENCE TO RELATED APPLICATIONS

This application claims the benefit of U.S. Provisional Application Serial No. 60/332,150, filed Nov. 21, 2001, which is incorporated herein by reference.

FIELD OF THE INVENTION

The present invention relates generally to food waste disposers and, more particularly, to a new waste line connector assembly for a food waste disposer.

BACKGROUND OF THE INVENTION

FIG. 1 depicts a typical food waste disposer 10. The food waste disposer 10 mounts to a sink (not shown) by a number of methods and techniques known in the art. In the present example, the disposer 10 mounts to the sink using a vibration isolation mounting system 60. The sink represents a first, substantially fixed point $P_1$ in the vibrational system of the disposer 10.

The disposer 10 includes an upper food conveying section 12, a lower motor section 14, and a central grinding section 16 disposed between the food conveying section 12 and the motor section 14. The food conveying section 12 is connected to the vibration isolation mounting system 60 and includes a housing 18 that forms an inlet 20 at its upper end for receiving food waste. The food conveying section 12 conveys the food waste to the central grinding section 16. The motor section 14 includes a motor 22 imparting rotational movement to a motor shaft 24. The motor 22 is enclosed within a motor housing 26. The grinding section 16 includes a grinding mechanism having lugs 36, a rotating plate 34, and a stationary shredder ring 38.

In the operation of the food waste disposer, the food waste delivered by the food conveying section 12 to the grinding section 16 is forced by lugs 36 against teeth 42 of the shredder ring 38. The edges of the teeth 42 grind the food waste into particulate matter sufficiently small to pass from above the grinding plate 34 to below the grinding plate 34 via gaps between the teeth 42 outside the periphery of the plate 34. Due to gravity and water, the particulate matter that passes through the gaps between the teeth 42 drops onto base frame 28 and, along with water injected into the disposer, is discharged through a discharge outlet 44 into a tailpipe 46 and a waste line 58.

As best shown in FIG. 2, one end 47 of the tailpipe 46 is connected to the discharge outlet 44 by a non-conventional fitting consisting of a gasket 48, a flange ring or connection member 50, and at least one bolt 52. Typically, the tailpipe 46, gasket 48, flange ring 50 and bolt(s) 52 are supplied with the disposer. The gasket 48 is made of rubber and fits over a flanged end 47 of the tailpipe 46. The flange ring 50 is made of metal and slips over the tailpipe 46. The flange ring 50 attaches to the discharge outlet 44 of the disposer with the bolt(s) 52. This compresses the gasket 48 between the flange ring 50 and the discharge outlet 44 of the disposer. At the other end of the tailpipe, a nut 54 and seal 56 are used to produce a slip joint to the other household plumbing of the waste line 58, which represents a second, substantially fixed point P2 in the vibrational system of the disposer. The slip joint is capable of a limited amount of axial movement and is capable of minimal radial movement. Consequently, the slip joint is incapable of sufficiently isolating vibrations from the disposer 10 to the waste line 58.

When operating, the disposer 10 can vibrate due to rotation of the motor 22 and the forces created within the disposer 10 when food waste is impacted. The vibration of the disposer 10 can include movement in all three axes. For simplicity, the vibrational movement is described herein as having an axial component A, a rotational component R, and a lateral component L, which can occur as the disposer 10 moves relative to fixed point $P_1$. It is understood that this description of the vibrational movement is merely used to simplify the discussion of vibration of the food waste disposer 10 and that the actual vibration of the disposer 10 can be described with more complexity.

The vibration of the disposer 10 due to the rotational forces and impacting of the food waste is transmitted through the rigid connection of the discharge 44 to the tailpipe 46. Although there is a gasket 48, once it is compressed sufficiently to seal against the disposer outlet 44 and the tailpipe 46, it becomes essentially rigid and transmits vibration. The joint between the tailpipe 46 and the waste line 58 (nut 54 and seal 56), while not perfectly rigid, is sufficiently constrained to transmit the vibration of the tailpipe 46 into the household plumbing 58.

As shown in FIG. 1, using the vibration isolation mounting system 60 between the disposer 10 and the sink reduces the amount of vibration transmitted from the disposer 10 to the fixed point $P_1$ of the sink. Reductions in sink vibration up to 85% have been found in tests. The typical vibration isolation mounting system 60 includes a flexible element 62 and flexible support posts 64 between the sink and the disposer 10, allowing for additional motion of the disposer 10 during grinding. A side effect of the additional motion of the disposer 10, however, is greater movement of the disposer 10 in the axial, rotational, and lateral directions A, R, L and higher forces acting upon the rigid connections in the tailpipe 46 and other plumbing of the waste line 58. These increased forces may eventually result in failure of the joints, creating leaks and may create additional noise during the operation of the disposer 10.

The present invention is directed to overcoming, or at least reducing the effects of, one or more of the problems set forth above.

SUMMARY OF THE INVENTION

To that end, the present invention provides a connector assembly for attaching a waste disposer to a waste line. In one embodiment, the connector assembly includes a flexible isolation coupler. The flexible isolation coupler has a flexible portion for absorbing the vibrational forces of the waste disposer.

The connector assembly may also include at least one rigid tubular body portion. The flexible isolation coupler may be attached to the discharge outlet of the waste disposer and between the discharge outlet of the waste disposer and the at least one rigid tubular body portion. In this case, the at least one rigid tubular body portion is attached to the waste line and between the flexible isolation coupler and the waste line.

The flexible isolation coupler may also be attached to the waste line and between the waste line and the at least one rigid tubular body portion. In this case, the at least one rigid tubular body portion is attached to the discharge outlet of the waste disposer and between the discharge outlet of the waste disposer and the flexible isolation coupler.

The at least one rigid tubular body portion may also include a first rigid tubular body portion and a second rigid tubular body portion. In this embodiment, the first rigid tubular body portion is attached to the discharge outlet of the waste disposer and between the discharge outlet of the waste disposer and the flexible isolation coupler. The second rigid tubular body portion is attached to the waste line and between the flexible isolation coupler and the waste line. The attachments of the first and second rigid tubular body portions to the flexible isolation coupler may be made by several means including by using ring clamps or other clamp devices or by integrally molding the components together.

In another embodiment, the connector assembly includes a flexible isolation coupler and a tubular tailpipe. The flexible isolation coupler has a first end, a second end, and a flexible portion. The first end of the flexible isolation coupler is attached to the discharge outlet of the waste disposer. The tubular tailpipe has a first end and a second end. The first end of the tubular tailpipe is attached to the second end of the flexible isolation coupler. The second end of the tubular tailpipe is attached to the waste line. The flexible portion of the flexible isolation coupler isolates the vibrational forces created in the disposer during operation from the waste line.

In yet another embodiment, the connector assembly has a first tubular tailpipe, a flexible isolation coupler, and a second tubular tailpipe. The first tubular tailpipe has a first end and a second end. The first end of the first tubular tailpipe is attached to the discharge outlet of the waste disposer. The flexible isolation coupler has a first end and a second end. The first end of the flexible isolation coupler is attached to the second end of the first tubular tailpipe. The second tubular tailpipe has a first end and a second end. The first end of the second tubular tailpipe is attached to the second end of the flexible isolation coupler. The second end of the second tubular tailpipe is attached to the waste line.

Another embodiment of the connector assembly is used to attach a discharge outlet of a waste disposer to a waste line where the waste line has an outer threaded portion. The connector assembly has a tubular tailpipe, a nut, and a flexible isolation coupler. The tubular tailpipe has a first end and a second end. The first end of the tubular tailpipe is attached to the discharge outlet. The nut has an inner threaded portion and an end portion. The inner threaded portion is capable of being attached to the outer threaded portion of the waste line. The flexible isolation coupler is attached to the nut. The flexible isolation coupler has a flexible lip. The second end of the tubular tailpipe is capable of being inserted into the flexible isolation coupler and through the flexible lip. The flexible lip of the flexible isolation coupler allows isolation the vibrational forces from the waste line that may be created in the disposer during operation.

In another embodiment of the present invention, the connector assembly includes a first tubular tailpipe, a flexible isolation coupler, and a second tubular tailpipe. The first tubular tailpipe has a first end and a second end. The first end of the first tubular tailpipe is attached to the discharge outlet of the waste disposer. The flexible isolation coupler has a first end and a second end. The first end of the flexible isolation coupler is attached to the second end of the first tubular tailpipe by a first ring clamp or other clamp device. The second tubular tailpipe has a first end and a second end. The first end of the second tubular tailpipe is attached to the second end of the flexible isolation coupler by a second ring clamp or other clamp device. The second end of the second tubular tailpipe is attached to the waste line.

Another embodiment of the present invention includes a connector assembly for a food waste disposer having a first rigid portion, a flexible isolation coupler, and a second rigid portion. The first rigid portion is tubular and has a first end and a second end. The first end of the first rigid portion is attached to the discharge outlet of the waste disposer. The flexible isolation coupler has a first end and a second end. The first end of the flexible isolation coupler is integrally molded to the second end of the first rigid portion. The second rigid portion is tubular and has a first end and a second end. The first end of the second rigid portion is integrally molded to the second end of the flexible isolation coupler. The second end of the second rigid portion is attached to the waste line.

The above summary of the present invention is not intended to represent each embodiment, or every aspect of the present invention. This is the purpose of the figures and detailed description, which follow.

BRIEF DESCRIPTION OF THE DRAWINGS

Other objects and advantages of the invention will become apparent upon reading the following detailed description and upon reference to the drawings.

Figure 1:
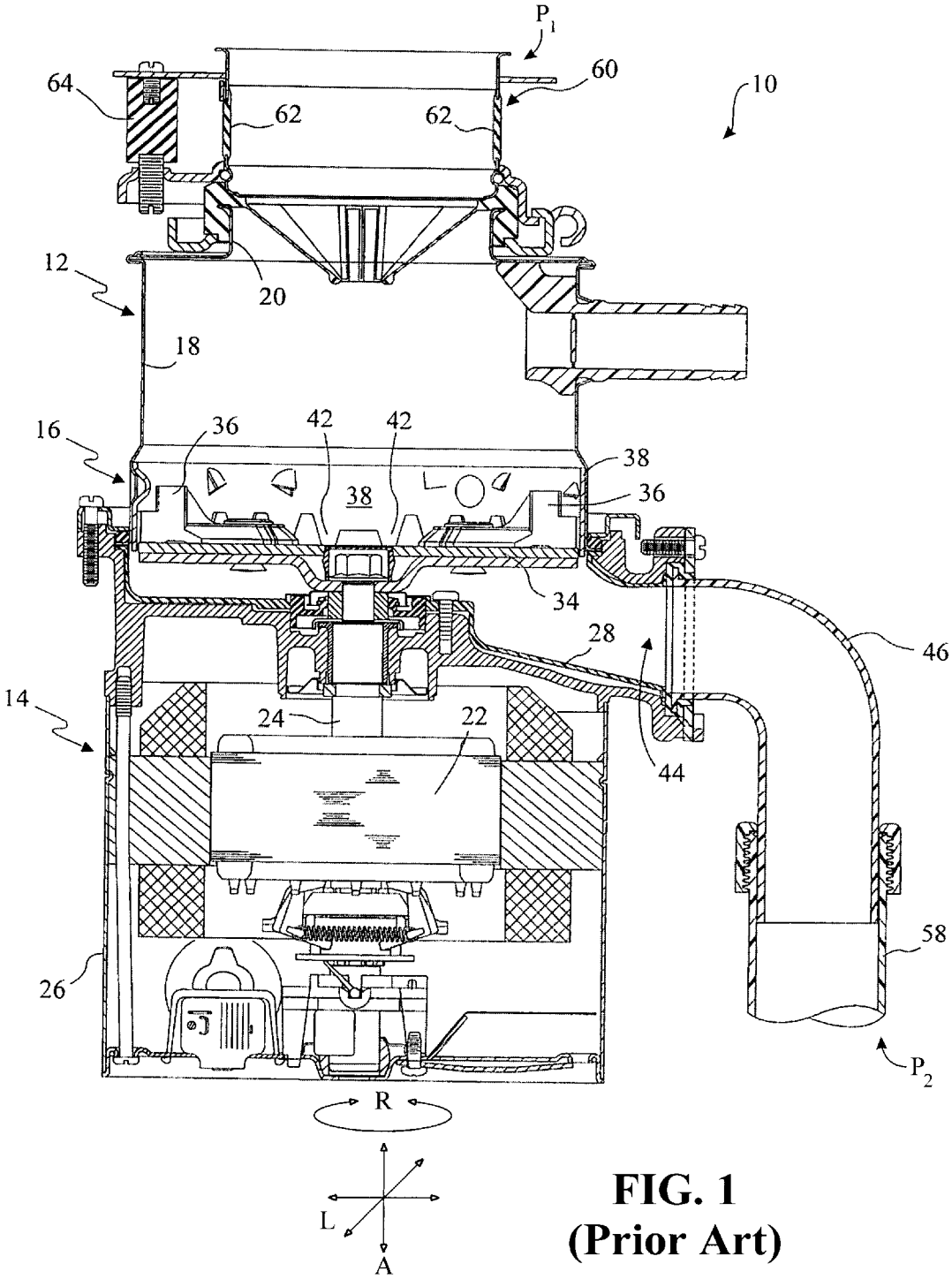
FIG. 1 (Prior Art)
FIG. 1 is a cross-section of a typical prior art food waste disposer.
Figure 2:
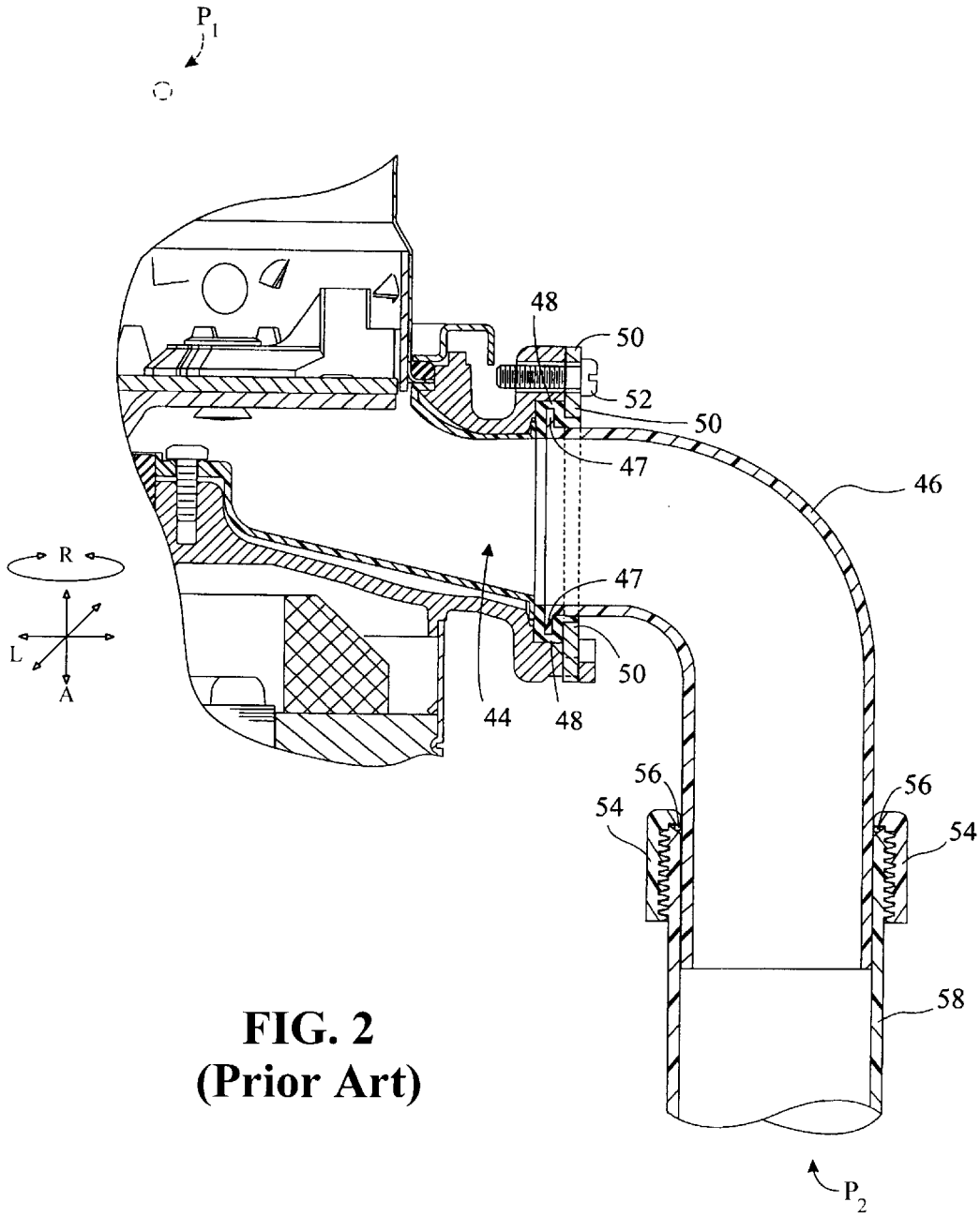
FIG. 2 (Prior Art)
FIG. 2 is an enlarged cross-section of a portion of the disposer in FIG. 1 showing a discharge outlet to a waste line.

While the invention is susceptible to various modifications and alternative forms, a specific embodiment thereof has been shown by way of example in the drawing and will herein be described in detail. It should be understood, however, that it is not intended to limit the invention to the particular forms disclosed but, on the contrary, to cover all modifications, equivalents, and alternatives falling within the spirit and scope of the invention as defined by the appended claims.

DESCRIPTION OF ILLUSTRATIVE EMBODIMENTS

Figures 3A, 3B:
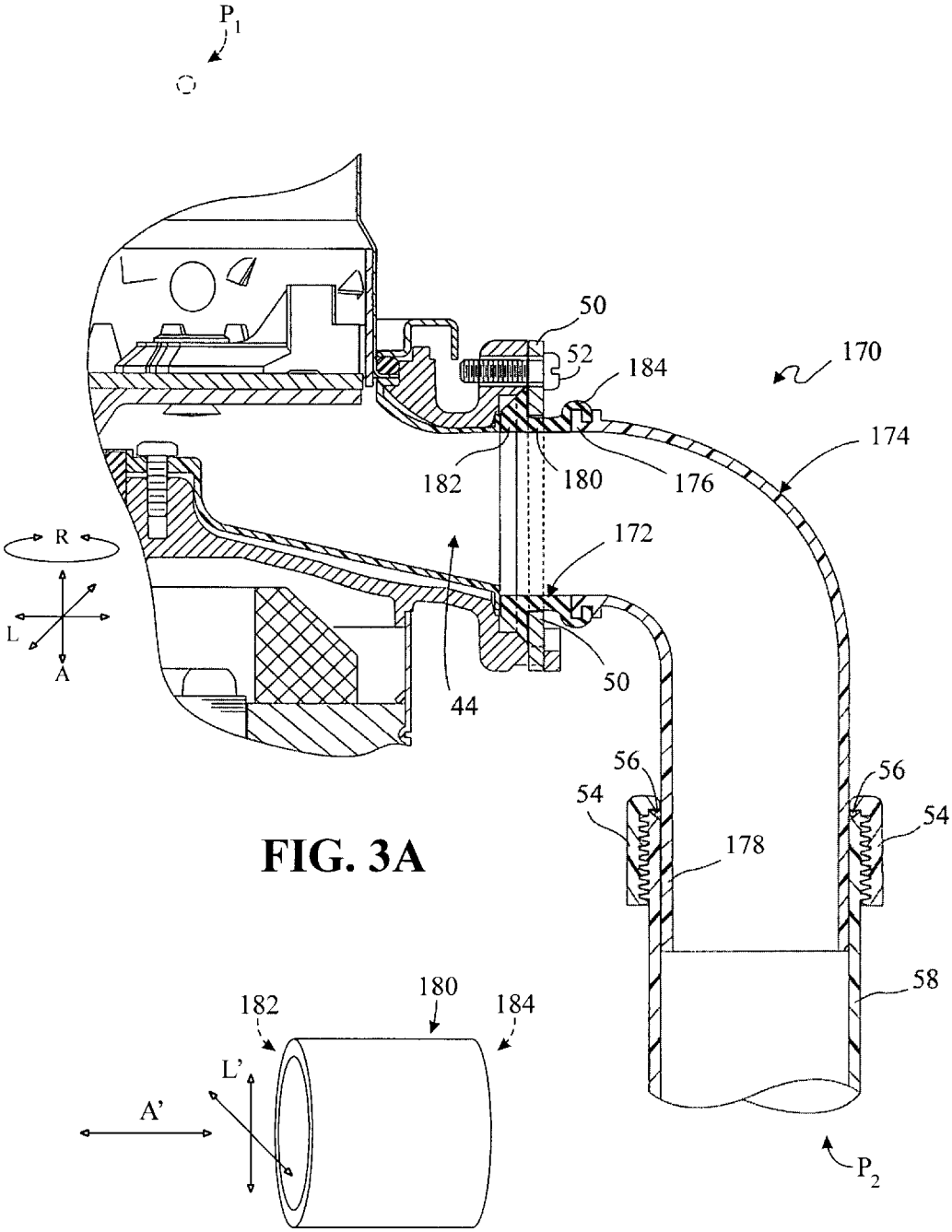
FIG. 3A is an enlarged cross-section of a portion of the disposer showing a waste line connector assembly for a first embodiment of the present invention.
FIG. 3B is a schematic illustration showing degrees of freedom for a flexible portion of the waste line connector assembly of the present invention.

Turning to the drawings, FIG. 3A depicts one embodiment of a waste line connector assembly 170 for a food waste disposer. The connector assembly 170 is suitable for disposers to reduce the vibrational forces that may be imposed on joints of the household waste line plumbing. As explained above in the background section, such vibrational forces may produce excess noise and leaks. This is especially true for disposers using a vibration isolation mounting system between the disposer and the sink as described above.

The waste line connector assembly 170 is used to attach a discharge outlet 44 of the disposer to a waste line 58. As shown in FIG. 3A, the connector assembly 170 includes a flexible isolation portion or coupler 172 and a rigid portion or tailpipe 174. In this embodiment, the rigid portion or tailpipe 174 is preferably tubular and made of a hard plastic material. Some suitable materials include acrylonitrile butadiene styrene (ABS), polyvinyl chloride (PVC), polyester, and polypropylene (PP). The flexible isolation portion or coupler 172 is made of rubber or other flexible material such as Thermoplastic Elastomers (TPEs) or Thermoplastic Rubbers (TPRs).

The flexible isolation coupler 172 has a flexible portion 180, which can be substantially tubular as shown, and has a first portion or end 182, and a second portion or end 184. The first end 182 directly couples or connects to the discharge outlet 44. The first end 182 has a flange member formed thereon and can be coupled to the discharge outlet 44 of the disposer with the use of a connection member 50. In the present embodiment, the connection member 50 is a flange ring made of metal that slips over the flexible portion 180 of the flexible isolation coupler 172 and attaches to the discharge outlet 44 of the disposer with one or more bolt(s) 52. This compresses the flange member of the first end 182 between the flange ring 50 and the discharge outlet 44 of the disposer. In an alternative embodiment to the use of the flange ring 50 and bolts 52, the connection member can be a threaded plumbers nut—not unlike that commonly used in the art—capable of disposing on the flexible portion 180. Such a connection member can attach to a complimentary discharge outlet (not shown) by threading thereon and can engage the flange member of the first end 182. As shown in FIG. 3A, the first end 182 may also have a geometry to allow it to act as a male connector and be pressed through the opening of the flange ring 50. The second end 184 of the flexible isolation coupler 172 couples to the tailpipe 174, which is used to indirectly couple or connect the flexible isolation coupler 172 to the waste line 58.

The tailpipe 174 has a first end 176 and a second end 178. The first end 176 couples to the flexible isolation coupler 172. In one embodiment, the tailpipe 174 may have the end 184 of the isolation coupler 172 over molded thereon. Alternatively, the first end 176 of the tailpipe 174 may have ridges that capture or trap the second end 184 of the flexible isolation coupler 172 as illustrated. In another alternative, the first end 176 may have the end 184 of the isolation coupler 172 held in place with a ring clamp or other clamp device (not shown) known in the art. The second end 178 of the tailpipe 174 has a straight tubular portion to provide attachment to the waste line 58. This attachment may be done by conventional methods as described in the background section. Namely, a nut 54 and seal 56 are used to produce a slip joint to the waste line 58.

Once the waste line connector assembly 170 is in place, the flexible portion 180 permits the connector assembly 170 to absorb vibrational forces that may occur during the operation of the disposer. For example, the flexible portion 180 can isolate the axial, lateral, and radial movements A, L, and R of the disposer discussed above without substantially disturbing the waste line 58.

In particular, the flexible portion 180, which is schematically illustrated in FIG. 3B, can flex in response to movements of the outlet with respect to the waste line during vibration of the disposer. The first end 182 is coupled to the disposer, and the second end 184 is coupled to the tailpipe connected to the waste line. Thus, the first end 182 is movable with the vibrations of the disposer, while the second end 184 is essentially fixed with respect to the first end 182.

Being flexible, the flexible portion 180 interposes a degree of freedom and preferably at least two degrees of freedom between the first end 182 coupled to the vibrating disposer and the second end 184 coupled to the essentially fixed waste line. In particular, the flexible portion 180 can expand and contract in an axial direction A' due to axial forces imposed thereon by vibration of the disposer. The flexible portion 180 can bend or flex in lateral directions L' due to lateral or shear forces imposed thereon by vibration of the disposer.

One benefit of interposing at least two degrees of freedom between the outlet 44 of the disposer and the waste line 58 includes the reduction of leaks and other problems as discussed above. Another benefit of the design in FIG. 3A is that it may be used with a standard disposer. In other words, the discharge outlet 44 of typical disposers does not need to be changed. The design also works well with a standard flange ring or other connection member 50.

Figure 4:
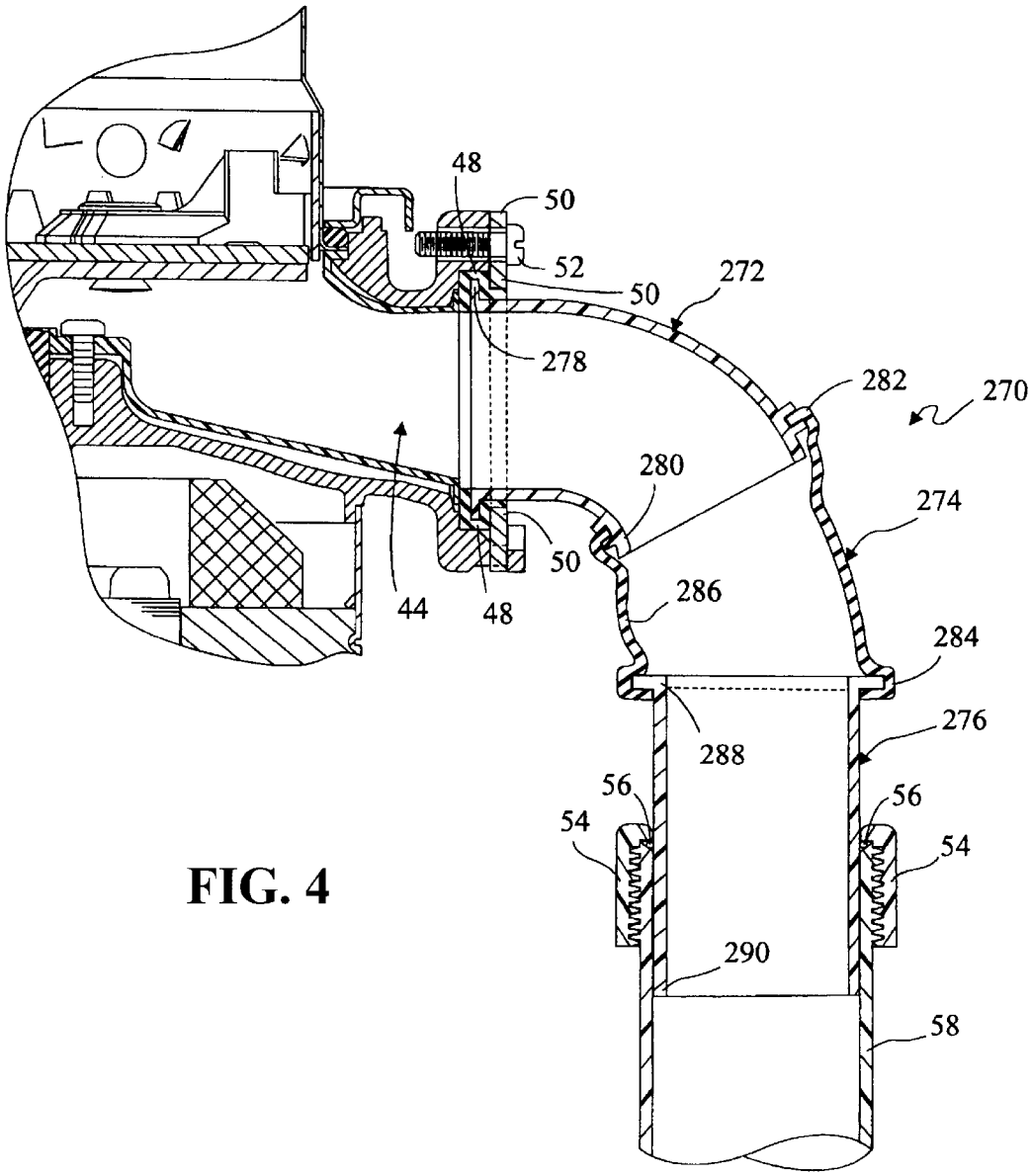
FIG. 4 is an enlarged cross-section of a portion of the disposer showing a waste line connector assembly for a second embodiment of the present invention.

The waste line connector assembly 170 in FIG. 3A introduces a vibration isolation feature at the connection of the tailpipe to the disposer. In another embodiment, as shown in FIG. 4, the vibration isolation feature is incorporated in a flexible section for isolating the tailpipe itself. FIG. 4 depicts a waste line connector assembly 270 for a food waste disposer. The connector assembly 270 is suitable for disposers to reduce the vibrational forces that may be imposed on joints of the household waste line plumbing. As explained above in the background section, such vibrational forces may produce excess noise and leaks. This is especially true for disposers using a vibration isolation mounting system between the disposer and the sink as described above.

The waste line connector assembly 270 in FIG. 4 is also used to attach a discharge outlet 44 of the disposer to a waste line 58. The connector assembly 270 includes a first rigid portion or tailpipe 272, a flexible isolation portion or coupler 274, and a second rigid portion or tailpipe 276. In this embodiment, the first and second tailpipes 272 and 276 are preferably tubular and made of a hard plastic material. Some suitable materials include acrylonitrile butadiene styrene (ABS), polyvinyl chloride (PVC), polyester, and polypropylene (PP). The flexible isolation coupler 274 is made of rubber or other flexible material such as Thermoplastic Elastomers (TPEs) or Thermoplastic Rubbers (TPRs).

The first tailpipe 272 has a first end 278 and a second end 280. The first end 278 may be attached to the discharge outlet 44 by the same fitting discussed above in the background section. This would include a gasket 48, a flange ring 50, and at least one bolt 52. The gasket 48 is made of rubber and fits over the first end 278 (which is flanged) of the first tailpipe 272. The flange ring 50 is made of metal and slips over the tailpipe 272. The flange ring 50 attaches to the discharge outlet 44 of the disposer with the bolt(s) 52. This compresses the gasket 48 between the flanged ring 50 and the discharge outlet 44 of the disposer.

The second end 280 of the first tailpipe 272 attaches to a first end or portion 282 of the flexible isolation coupler 274. The end 282 of the flexible isolation coupler 274 may be over molded onto the second end 280 of the tailpipe 272.

Alternatively, the second end 280 of the tailpipe 272 may have ridges that capture or trap the end 282 of the flexible isolation coupler 274 or may be held in place with a ring clamp or other clamp device (not shown) known in the art.

The flexible isolation coupler 274 has a first end 282, a second end 284, and a flexible portion 286, which can be substantially tubular as shown. The first end 282 attaches to the first tailpipe 272 as discussed above. The second end 284 of the flexible isolation coupler 274 attaches to the second tailpipe 276. This second end 284 of the flexible isolation coupler 274 may be over molded onto the second tailpipe 276. Alternatively, the second tailpipe 276 may have ridges that capture or trap the second end 284 of the flexible isolation coupler 274 or may be held in place with a ring clamp or other clamp device (not shown) known in the art.

The second tailpipe 276 has a first end 288 and a second end 290. In one embodiment, the first end 288 is attached to the flexible isolation coupler 274 as described above. The second end 290 has a straight tubular portion to provide attachment to the waste line 58. This attachment may be done by conventional methods as described in the background section. Namely, a nut 54 and seal 56 are used to produce a slip joint to the waste line 58.

Once the waste line connector assembly 270 is in place, the flexible portion 286 permits the connector assembly 270 to absorb vibrational forces that may occur during the operation of the disposer. The flexible portion 286 isolates movements of the disposer without substantially disturbing the waste line 58. This reduces leaks and other problems as discussed above. Another benefit of the design in FIG. 4 is that it may be used with a standard disposer. In other words, the discharge outlet 44 of typical disposers does not need to be changed.

Figure 5A:
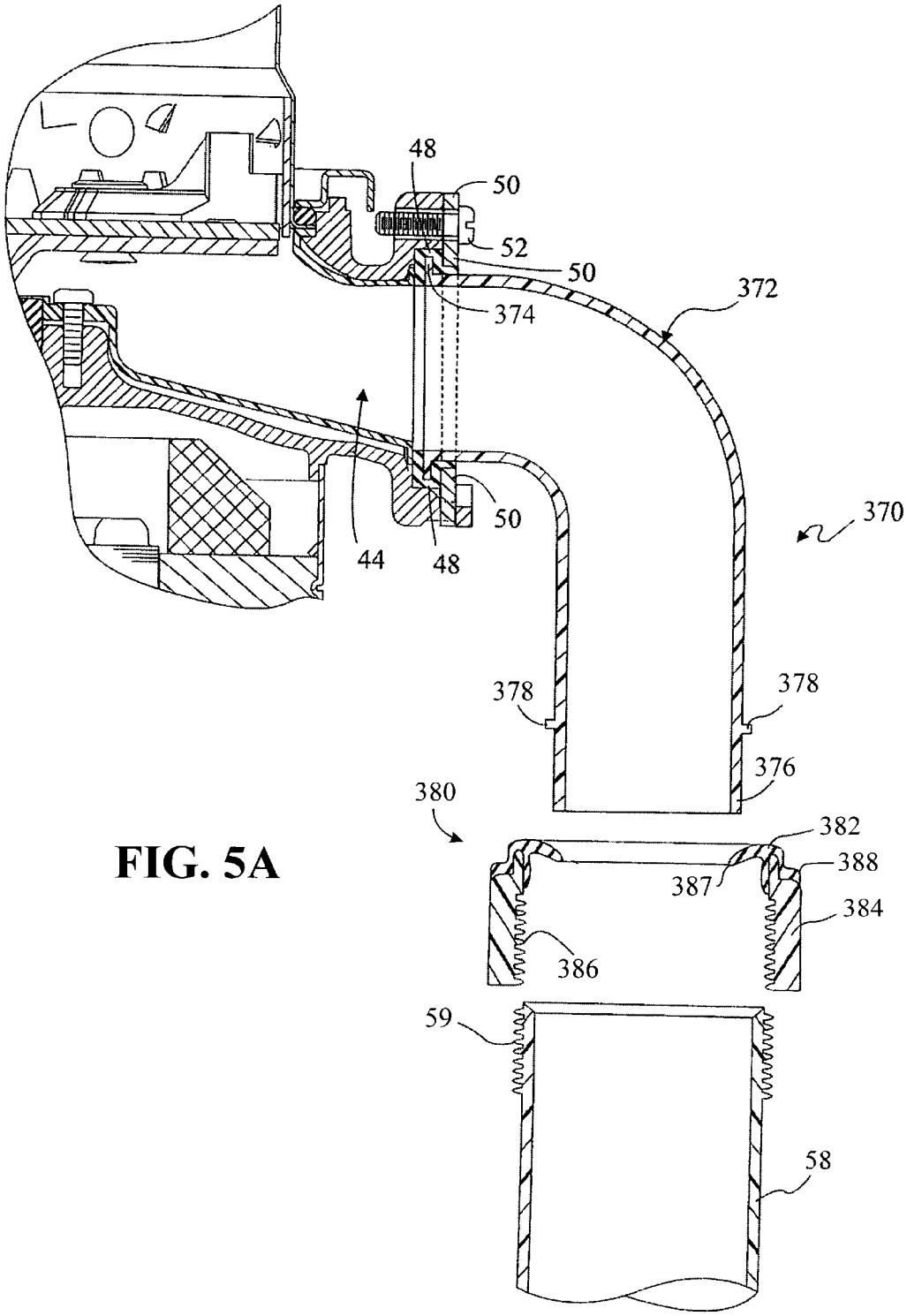
FIGS. 5A and 5B are enlarged cross-sections of portions of the disposer showing a waste line connector assembly for a third embodiment of the present invention.
Figure 5B:
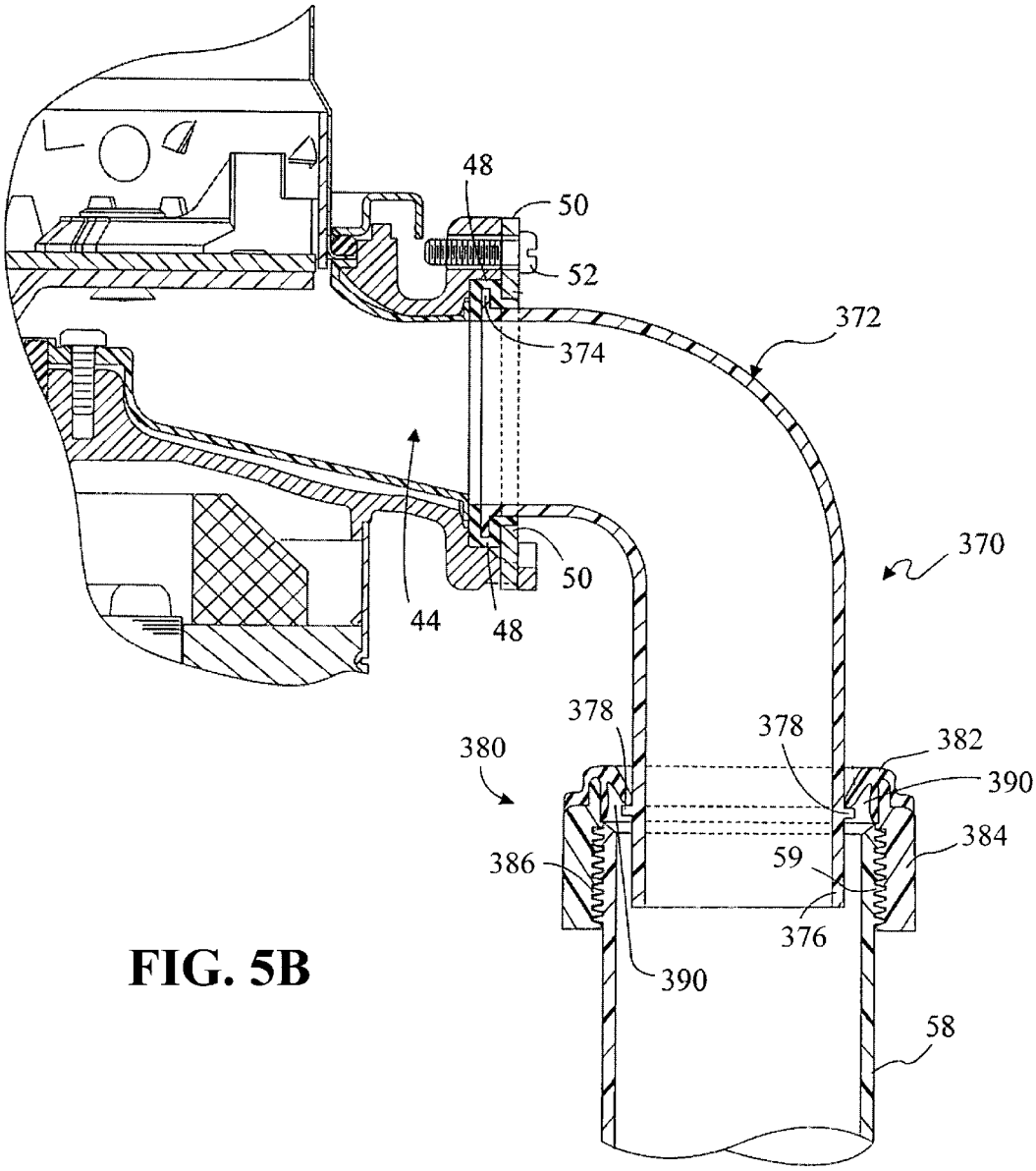

FIGS. 5A and 5B show another embodiment of a waste line connector assembly 370. FIG. 5A shows an exploded view of the connector assembly 370, and FIG. 5B shows an assembled version of the connector assembly 370. The waste line connector assembly 370 in this embodiment introduces a vibration isolation feature at a connection of a rigid portion or tailpipe 372 to the waste line 58. Like the previous embodiments, the connector assembly 370 is suitable for disposers to reduce the vibrational forces that may be imposed on joints of the household waste line plumbing. As explained above in the background section, such vibrational forces may produce excess noise and leaks. This is especially true for disposers using a vibration isolation mounting system between the disposer and the sink as described above.

The waste line connector assembly 370 is used to connect a discharge outlet 44 of the disposer to a waste line 58. As shown in FIGS. 5A and 5B, the connector assembly 370 includes the rigid portion or tailpipe 372 and a flexible isolation portion or coupler 380. In this embodiment, the tailpipe 372 is preferably tubular and made of a hard plastic material. Some suitable materials include acrylonitrile butadiene styrene (ABS), polyvinyl chloride (PVC), polyester, and polypropylene (PP).

The tailpipe 372 has a first end 374 and a second end 376. The first end 374 may be coupled to the discharge outlet 44 by the same fitting discussed above in the background section. This would include a gasket 48, a flange ring 50, and at least one bolt 52. The gasket 48 is made of rubber and fits over the first end 374 (which is flanged) of the tailpipe 372. The flange ring 50 is made of metal and slips over the tailpipe 372. The flange ring 50 attaches to the discharge outlet 44 of the disposer with the bolt(s) 52. This compresses the gasket 48 between the flanged ring 50 and the discharge outlet 44 of the disposer. The second end 376 of the tailpipe 372 couples to the flexible isolation coupler 380. In this embodiment, the second end 376 has a rib 378 that inserts into and engages with the flexible isolation coupler 380 as described below.

The flexible isolation coupler 380 includes a flexible portion or lip 382 and a second portion or nut 384. The flexible lip 382 is a continuous annular member having an inner dimension 387 and an outer dimension 388. Alternatively, the flexible isolation coupler 380 need not be formed as a continuous annular member but can include a plurality of flexible segments formed adjacent one another in an annular arrangement. The second end 376 of the tailpipe 372 is capable of movably disposing in the inner dimension or passage 387 formed through the flexible isolation coupler 380 and is capable of engaging the inner dimension of the lip 382. The outer dimension 388 of the lip 382 is molded or formed onto the nut 384. The flexible lip 382 is made of rubber or other flexible material such as Thermoplastic Elastomers (TPEs) or Thermoplastic Rubbers (TPRs). The nut 384 is preferably made of PVC or other types of hard plastic material. The nut 384 has an inner threaded portion 386 so that it may be attached to an outer threaded portion 59 of the waste line 58. As an alternative embodiment, a reverse arrangement can be used where the nut 384 threads onto the second end 376 of the tailpipe 372, which would be threaded, and where the flexible lip 382 engages an end of the waste line 58. The flexible isolation coupler 380 may also be formed of a single material, e.g., a hard but flexible rubber, that is sufficiently malleable to absorb vibrational forces, but hard enough to form a nut capable of screwing onto the pipe 58.

As shown in the assembled version of the waste line connector assembly 370 in FIG. 5B, the second end 376 of the tailpipe 372 is inserted into the flexible lip 382 of the isolation coupler 380. The tailpipe 372 is inserted until the rib 378 passes through the flexible lip 382. The flexible lip 382 induces compressive forces around the outer perimeter of the tailpipe 372 to hold it in place. The downward and inward shape of the flexible lip 382 and the protruding shape of the rib 378 prevent the tailpipe 372 from coming out of the flexible isolation coupler 380.

In the final assembled version of the waste line connector assembly 370, an air gap 390 is preferably provided between the downward protruding flexible lip 382 and the nut 384. The flexible lip 382 allows the tailpipe 372 to move or vibrate in axial, lateral, and radial directions without substantially disturbing the waste line 58 by permitting the rigid second end 376 to move in the flexible lip 382 while maintaining engagement therewith. In other words, the flexible lip 382 permits the connector assembly 370 to absorb vibrational forces that may occur during the operation of the disposer. This reduces leaks and other problems as discussed above. Another benefit of the design in FIG. 5B is that it may be used with a standard disposer. In other words, the discharge outlet 44 of typical disposers does not need to be changed.

Figure 6:
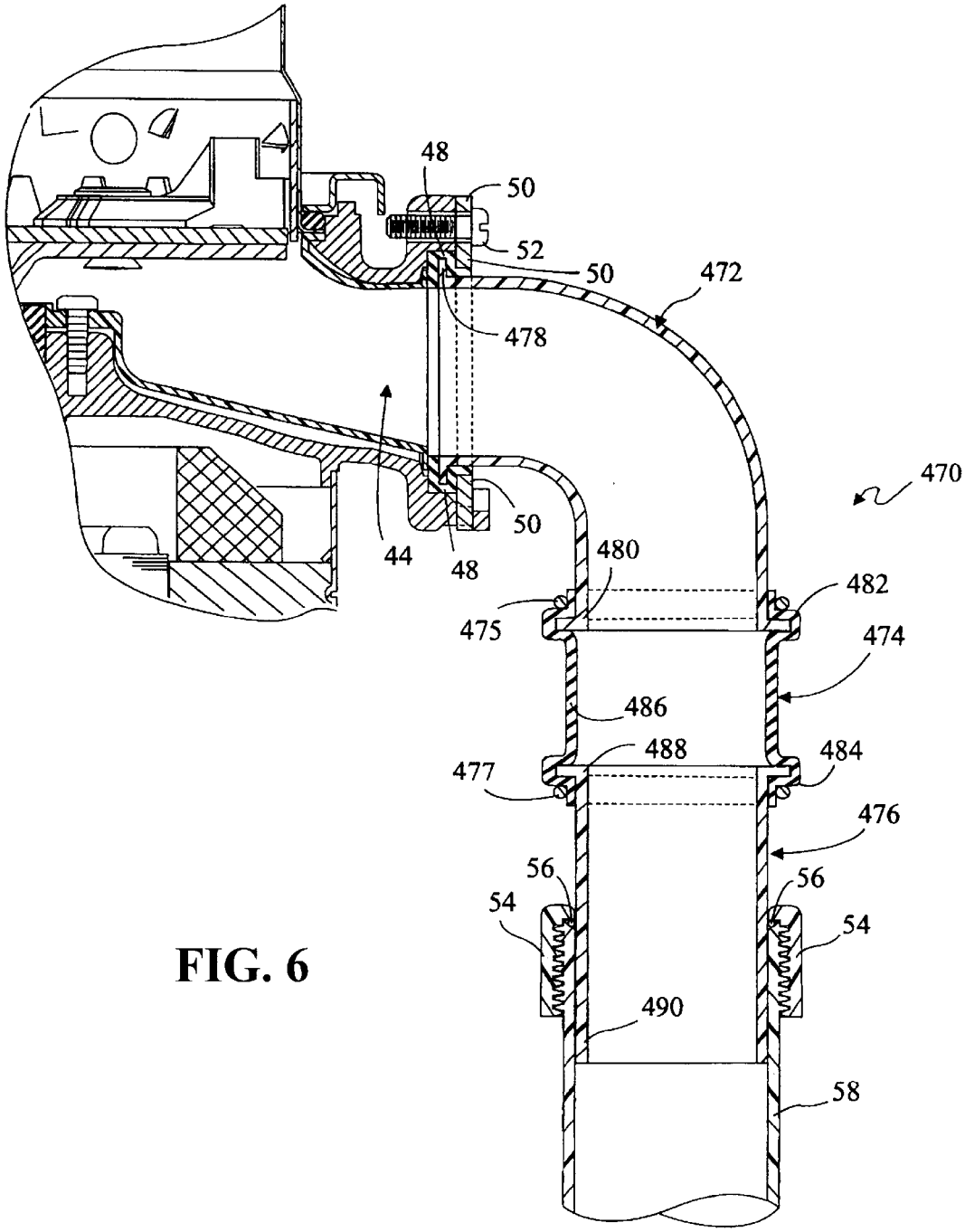
FIG. 6 is an enlarged cross-section of a portion of the disposer showing a waste line connector assembly for a fourth embodiment of the present invention.

In another embodiment, as shown in FIG. 6, a waste line connector assembly 470 for a food waste disposer has a flexible member or portion incorporated into the tailpipe. The connector assembly 470 is suitable for disposers to reduce the vibrational forces that may be imposed on joints of the household waste line plumbing. As explained above in the background section, such vibrational forces may produce excess noise and leaks. This is especially true for disposers using a vibration isolation mounting system between the disposer and the sink as described above.

The waste line connector assembly 470 in FIG. 6 is also used to attach a discharge outlet 44 of the disposer to a waste line 58. The connector assembly 470 includes a first rigid portion or tailpipe 472, a flexible isolation portion or coupler 474, and a second rigid portion or tailpipe 476. In this embodiment, the first and second tailpipes 472 and 476 are preferably tubular and made of a hard plastic material. Some suitable materials include acrylonitrile butadiene styrene (ABS), polyvinyl chloride (PVC), polyester, and polypropylene (PP). The flexible isolation coupler 474 is made of rubber or other flexible material such as Thermoplastic Elastomers (TPEs) or Thermoplastic Rubbers (TPRs).

The first tailpipe 472 has a first end 478 and a second end 480. The first end 478 may be attached to the discharge outlet 44 by the same fitting discussed above in the background section. This would include a gasket 48, a flange ring 50, and at least one bolt 52. The gasket 48 is made of rubber and fits over the first end 478 (which is flanged) of the first tailpipe 472. The flange ring 50 is made of metal and slips over the first tailpipe 472. The flange ring 50 attaches to the discharge outlet 44 of the disposer with the bolt(s) 52. This compresses the gasket 48 between the flanged ring 50 and the discharge outlet 44 of the disposer. The second end 480 of the first tailpipe 472 attaches to a first end or portion 482 of the flexible isolation coupler 474. In this embodiment, the first end 482 of the flexible isolation coupler 474 is held in place with a ring clamp or clamp device 475.

The flexible isolation coupler 474 has a first portion or end 482, a second portion or end 484, and a flexible portion 486, which can be substantially tubular as shown. The first end 482 attaches to the first tailpipe 472 with a ring clamp or clamp device 475 as discussed above. The second end 484 of the flexible isolation coupler 474 attaches to the second tailpipe 476. In this embodiment, this second end 484 of the flexible isolation coupler 474 is held in place with a ring clamp or clamp device 477.

The second tailpipe 476 has a first end 488 and a second end 490. In one embodiment, the first end 488 is attached to the flexible isolation coupler 474 with the ring clamp 477 as described above. The second end 490 has a straight tubular portion to provide attachment to the waste line 58. This attachment may be done by conventional methods as described in the background section. Namely, a nut 54 and seal 56 are used to produce a slip joint to the waste line 58.

Once the waste line connector assembly 470 is in place, the flexible portion 486 permits the connector assembly 470 to absorb vibrational forces that may occur during the operation of the disposer. The flexible portion 486 isolates movements of the disposer without substantially disturbing the waste line 58. This reduces leaks and other problems as discussed above. Another benefit of the design in FIG. 6 is that it may be used with a standard disposer. In other words, the discharge outlet 44 of typical disposers does not need to be changed.

Figure 7:
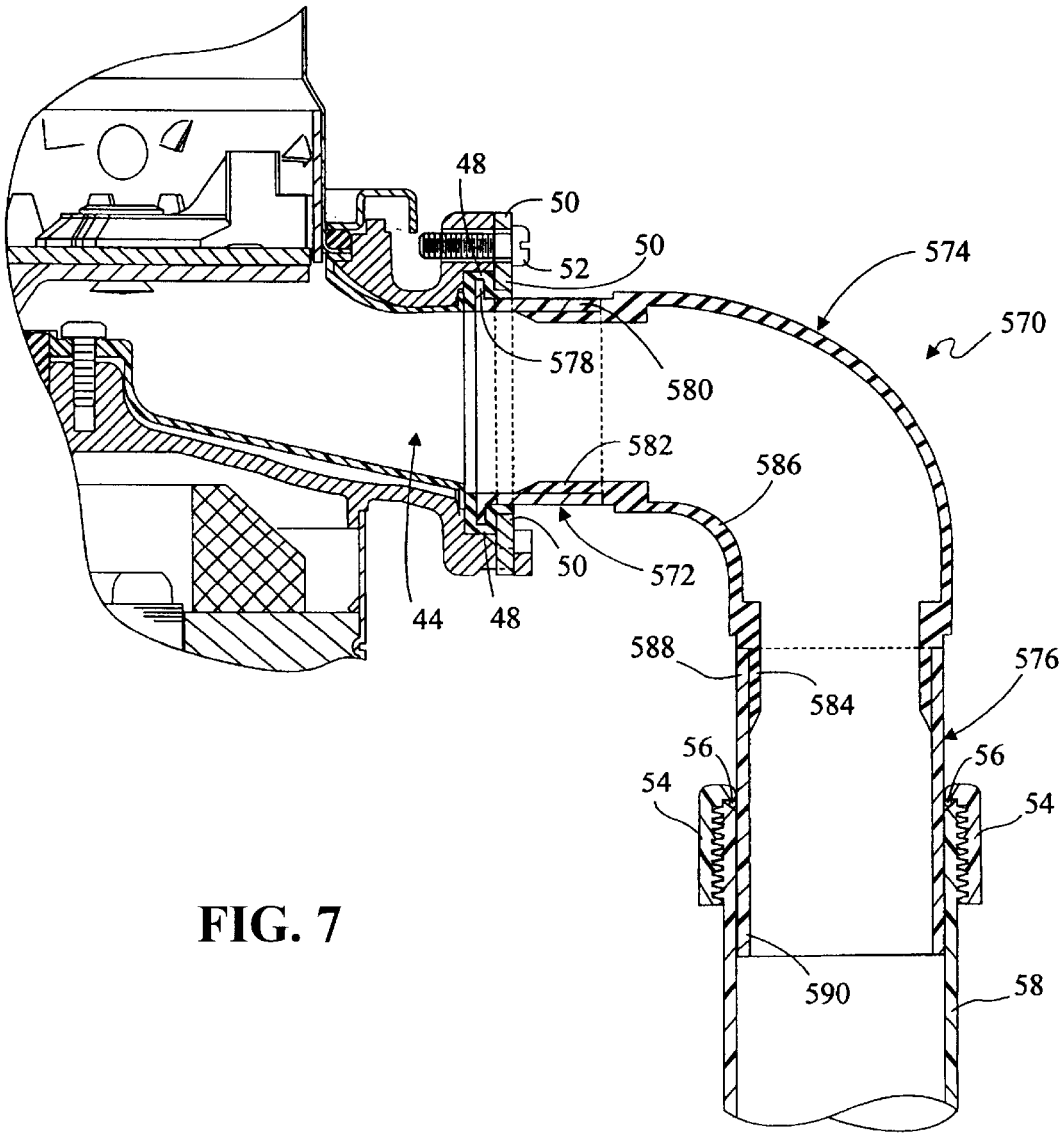
FIG. 7 is an enlarged cross-section of a portion of the disposer showing a waste line connector assembly for a fifth embodiment of the present invention.

In yet another embodiment, as shown in FIG. 7, a waste line connector assembly 570 for a food waste disposer has a flexible member or portion incorporated into the tailpipe. Alternatively, the entire tailpipe may be made of a flexible material. The connector assembly 570 is suitable for disposers to reduce the vibrational forces that may be imposed on joints of the household waste line plumbing. As explained above in the background section, such vibrational forces may produce excess noise and leaks. This is especially true for disposers using a vibration isolation mounting system between the disposer and the sink as described above.

The waste line connector assembly 570 in FIG. 7 is also used to attach a discharge outlet 44 of the disposer to a waste line 58. The connector assembly 570 includes a first rigid portion 572, a flexible isolation portion or coupler 574, and a second rigid portion 576. In this embodiment, the first and second rigid portions 572 and 576 are preferably made of a hard plastic material. Some suitable materials include acrylonitrile butadiene styrene (ABS), polyvinyl chloride (PVC), polyester, and polypropylene (PP). The flexible isolation coupler 574 is made of rubber or other flexible material such as Thermoplastic Elastomers (TPEs) or Thermoplastic Rubbers (TPRs).

The first rigid portion 572 has a first end 578 and a second end 580. The first end 578 may be attached to the discharge outlet 44 by the same fitting discussed above in the background section. This would include a gasket 48, a flange ring 50, and at least one bolt 52. The gasket 48 is made of rubber and fits over the first end 578 (which is flanged) of the first rigid portion 572. The flange ring 50 is made of metal and slips over the first rigid portion 572. The flange ring 50 attaches to the discharge outlet 44 of the disposer with the bolt(s) 52. This compresses the gasket 48 between the flanged ring 50 and the discharge outlet 44 of the disposer.

The second end 580 of the first rigid portion 572 attaches to an end 582 of the flexible isolation coupler 574. In this embodiment, the end 582 of the flexible isolation coupler 574 is integrally molded with the second end 580 of the first rigid portion 572. The integrally molded attachment may be formed on the inner surface of the first rigid portion 572 (as shown in FIG. 7), on the outer surface of the first rigid portion 572, or both the inner surface and outer surface of the first rigid portion 572.

The flexible isolation coupler 574 has a first end or portion 582, a second end or portion 584 and a flexible portion 586, which can be substantially tubular as shown. The first end 582 attaches to the first rigid portion 572 as discussed above. The second end 584 of the flexible isolation coupler 574 attaches to the second rigid portion 576. In this embodiment, this second end 584 of the flexible isolation coupler 574 is integrally molded with the end 588 of the second rigid portion 576. The integrally molded attachment may be formed on the inner surface of the first rigid portion 572 (as shown in FIG. 7), on the outer surface of the first rigid portion 572, or both the inner surface and outer surface of the first rigid portion 572.

The second rigid portion 576 has a first end 588 and a second end 590. In one embodiment, the first end 588 is attached to the flexible isolation coupler 574 as described above. The second end 590 has a straight tubular portion to provide attachment to the waste line 58. This attachment may be done by conventional methods as described in the background section. Namely, a nut 54 and seal 56 are used to produce a slip joint to the waste line 58. Alternatively, the components 586, 572, and 576 can be formed of a uniform material that is both flexible enough to absorb vibrational forces but rigid enough to mechanically couple to the discharge outlet 44 and the waste line 58.

Once the waste line connector assembly 570 is in place, the flexible portion 586 permits the connector assembly 570 to absorb vibrational forces that may occur during the operation of the disposer. The flexible portion 586 isolates movements of the disposer without substantially disturbing the waste line 58. This reduces leaks and other problems as discussed above. Another benefit of the design in FIG. 7 is that it may be used with a standard disposer. In other words, the discharge outlet 44 of typical disposers does not need to be changed.

Figure 8A:
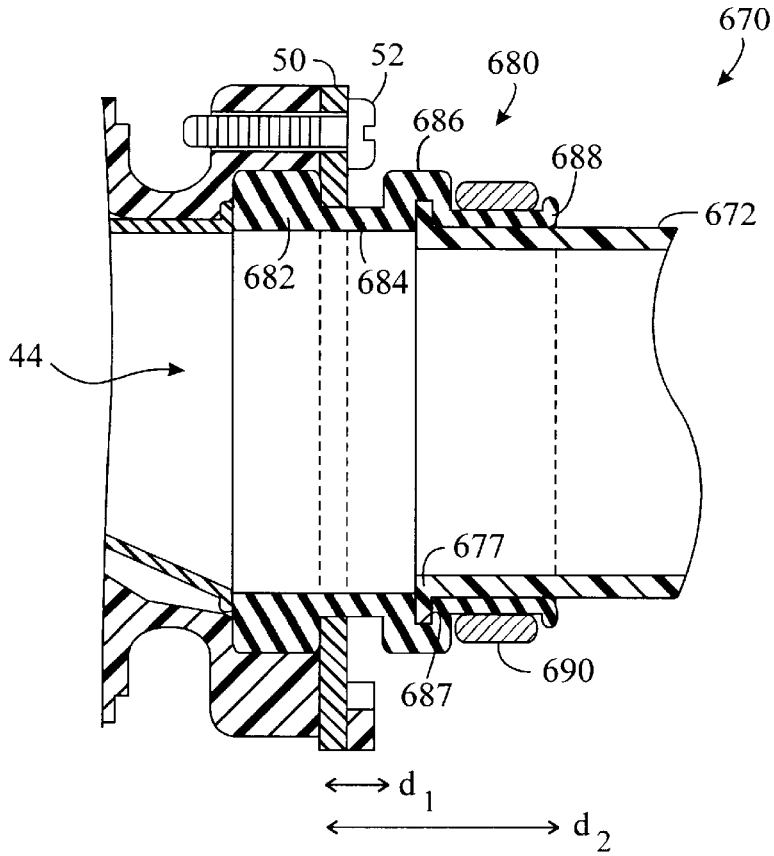
FIG. 8A is an enlarged cross-section of a portion of the disposer showing a waste line connector assembly for a sixth embodiment of the present invention.
Figure 8B:
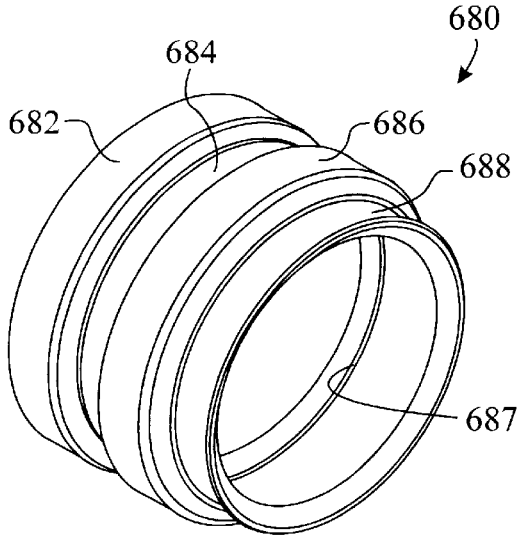
FIG. 8B is a perspective view of the tailpipe isolation gasket of the waste line connector assembly of FIG. 8A.

Referring to FIGS. 8A–B, yet another embodiment of a waste line connector assembly 670 for a food waste disposer is illustrated. In FIG. 8A, the waste line connector assembly 670 is shown coupled to a discharge outlet 44 of the disposer, which is only partially shown. The connector assembly 670 includes a rigid portion or tailpipe 672, a flexible isolation portion or coupler 680, and a clamp device 690. In FIG. 8B, the isolation coupler 680 of the assembly 670 is shown in a perspective view to show relevant details.

The tailpipe 672 is preferably made of a hard plastic material, such as acrylonitrile butadiene styrene (ABS), polyvinyl chloride (PVC), polyester, or polypropylene (PP). At least a portion or all of the isolation coupler 680 is flexible. Consequently, the isolation coupler 680 can be made of rubber or other flexible material, such as Thermoplastic Elastomers (TPEs) or Thermoplastic Rubbers (TPRs).

The waste line connector assembly 670 introduces a vibration isolation feature at a connection of the tailpipe 672 to the discharge outlet 44. The connector assembly 670 is suitable for reducing the vibrational forces imposed on joints of the household waste line plumbing. As explained above in the background section, such vibrational forces may produce excess noise and leaks, which is especially true for disposers using a vibration isolation mounting system between the disposer and the sink as described above.

The isolation coupler 680 has a first portion or end 682, an isolation or flexible portion 684, an intermediate portion 686, and a second portion or end 688. In the present embodiment, the isolation coupler 680 directly couples or connects to the discharge outlet 44. In particular, the first portion 682 has a flange member formed thereon and is directly coupled to the discharge outlet 44 of the disposer with the use of a flange ring or connection member 50. The flange ring 50 is made of metal and fits around part of the isolation portion 684 of the flexible isolation coupler 670. The first flanged portion 682 is disposed in the outlet 44, and the flange ring 50 attaches to the discharge outlet 44 with one or more bolts 52. Thus, the flanged first portion 682 is compressed between the flange ring 50 and the discharge outlet 44 of the disposer and creates a substantially fluid tight interface.

The isolation portion 684 is adjacent the flanged first portion 682 held in the discharge outlet 44. In one embodiment of the present invention, the isolation portion 684 has a length of approximately 0.25-inch and has a thickness of approximately 0.1 to 0.2-inch, which produces suitable flexibility for the present embodiment. The internal diameter defined by of the flanged first portion 682 and the isolation portion 684 is approximately 1.44-inch. One of ordinary skill in the art will recognize that the dimensions presented herein are only exemplary and can be changed depending on a number of variables, including the required amount of vibration isolation and the flexibility of material used.

In the present embodiment, the isolation coupler assembly connects to the waste line (not shown). The intermediate portion 686, which is adjacent the isolation portion 684, defines an internal recess 687. The second portion 688 of the flexible isolation coupler 670 in the present embodiment fits over the tailpipe 672, and a flanged end 677 of the tailpipe 672 disposes in the internal recess 687. The internal diameter defined by the second portion 688 is approximately 1.47-inch, and the second portion 688 can have a length of approximately 0.37-inch. The clamp device 690 is positioned around the second portion 688 to couple the isolation coupler 680 to the tailpipe 672. The clamp device 690 also maintains the flanged end 677 of the tailpipe 672 in the recess, 687 of the intermediate flanged portion 686.

The clamp device 690 can be any suitable device for holding the second portion 688 on the tailpipe 672. For example, the clamp device 690 can be a spring clip or can be a standard ring clamp having a rotatable gear (not shown) for tightening. One of ordinary skill in the art will appreciate that a number of clamp devices known in the art can be used to attach the second portion 688 to the tailpipe 672. In addition, it will also be appreciated that the second portion 688 can be molded over the tailpipe 672 or can be coupled thereto by other methods and techniques disclosed herein.

As best described in other embodiments, the tailpipe 672 can have a bend (not shown) and a straight tubular portion (not shown) to provide attachment to a waste line (not shown). The attachment may be done by conventional methods as described in the background section, such as with a nut and seal to produce a slip joint to the waste line.

Once the waste line connector assembly 670 is in place, the isolation portion 684 permits the connector assembly 670 to absorb vibrational forces that may occur during the operation of the disposer without substantially transmitting the forces to the waste line, which reduces leaks and other problems as discussed above. Being flexible, the connector assembly 670 interposes flexible movement between the coupling of the discharge outlet 44 to the waste line (not shown). Defining a passage, the connector assembly 670 is also capable of communicating waste from the discharge outlet 44 to the waste line. The isolation coupler 670 of FIGS. 8A–B can be used with a standard disposer so that the discharge outlet 44 of a typical disposer does not need to be changed. The isolation coupler 670 also works well with a standard flange ring or other connection member 50.

It is intended that the disclosed assembly and food waste disposer include all such modifications and alterations to the full extent that they come within the scope of the following claims or the equivalents thereof. Moreover, it should be noted that the various tailpipe isolation schemes disclosed herein can be useful together, or in various combinations, to even further increase the degree of isolation.

What is claimed is:

1. An assembly for communicating waste from a discharge outlet of a food waste disposer to a waste line, the assembly comprising:

an isolation portion being at least partially flexible for isolating vibration of the disposer and defining a passage between first and second ends for communicating waste;

a first connection portion for connecting the first end of the isolation portion to the discharge outlet; and a second connection portion for connecting the second end of the isolation portion to the waste line.

2. The assembly of claim 1, wherein the isolation portion comprises a flexible body portion being substantially tubular and composed of rubber, Thermoplastic Elastomers (TPEs), or Thermoplastic Rubbers (TPRs).

3. The assembly of claim 1, wherein the first connection portion comprises a flange member integrally formed on the first end of the isolation portion.

4. The assembly of claim 3, wherein the first connection portion comprises a connection member disposed on the isolation portion, the connection member attaching to the discharge outlet and engaging the flange member.

5. The assembly of claim 1, wherein the first connection portion comprises a first rigid portion coupled to the first end of the isolation portion.

6. The assembly of claim 5, wherein the first rigid portion is substantially tubular and composed of plastic.

7. The assembly of claim 5, wherein:

the first rigid portion comprises a first flanged end, and the first connection portion comprises a connection member disposing on the first rigid portion, the connection member attaching to the discharge outlet and engaging the first flanged end.

8. The assembly of claim 5, wherein the first rigid portion is integrally molded to the first end of the isolation portion.

9. The assembly of claim 5, wherein the first rigid portion comprises a second flanged end, the second flanged end engaging a recess defined in the passage of the isolation portion.

10. The assembly of claim 5, wherein the first connection portion comprises a first clamp device attaching an end of the first rigid portion to the first end of the isolation portion.

11. The assembly of claim 1, wherein the second connection portion comprises a second rigid portion coupled to the second end of the isolation portion.

12. The assembly of claim 11, wherein the second rigid portion is integrally molded to the second end of the isolation portion.

13. The assembly of claim 11, wherein the second rigid portion comprises a flanged end, the flanged end engaging a recess defined in the passage of the isolation portion.

14. The assembly of claim 11, wherein the second connection portion comprises a second clamp device attaching an end of the second rigid portion to the second end of the isolation portion.

15. The assembly of claim 1, wherein:

the first connection portion comprises a first rigid portion coupled to the first end of the isolation portion, and the second connection portion comprises a second rigid portion coupled to the second end of the isolation portion.

16. An assembly for communicating waste from a discharge outlet of a food waste disposer to a waste line, the assembly comprising:

an isolation portion being at least partially flexible for isolating vibration of the disposer, the isolation portion comprising a substantially annular member having an inner dimension and an outer dimension;

a first connection portion for connecting the isolation portion to the discharge outlet, the first connection portion comprising a rigid portion movably disposing in the substantially annular member and engaging the inner dimension; and a second connection portion for connecting the outer dimension of the isolation portion to the waste line.

17. The assembly of claim 16, wherein the rigid portion comprises a rim adjacent the inner dimension.

18. The assembly of claim 16, wherein the second connection portion comprises a threaded member integrally molded to the outer dimension and capable of threading onto the waste line.

19. A food waste disposer connectable to a waste line and having a grinding section, comprising:

a discharge outlet for discharging waste from the grinding section; and an assembly for communicating waste from the discharge outlet of the food waste disposer to the waste line, the assembly comprising:

first means for coupling to the discharge outlet;

second means for coupling to the waste line; and means for isolating vibration between the first and second means.

20. A food waste disposer connectable to a waste line, comprising:

a discharge outlet; and an assembly for communicating waste from the discharge outlet to the waste line, comprising:

an isolation portion being at least partially flexible for isolating vibration of the disposer and defining a passage between first and second ends, a first connection portion for connecting the first end of the isolation portion to the discharge outlet, and a second connection portion for connecting the second end of the isolation portion to the waste line.

21. The food waste disposer of claim 20, wherein the isolation portion comprises a flexible body portion being substantially tubular and composed of rubber, Thermoplastic Elastomers (TPEs), or Thermoplastic Rubbers (TPRs).

22. The food waste disposer of claim 20, wherein the first connection portion comprises a flange member integrally formed on the first end of the isolation portion.

23. The food waste disposer of claim 22, wherein the first connection portion comprises a connection member disposed on the isolation portion, the connection member attaching to the discharge outlet and engaging the flange member.

24. The food waste disposer of claim 20, wherein the first connection portion comprises a first rigid portion coupled to the first end of the isolation portion.

25. The food waste disposer of claim 24, wherein the first rigid portion is substantially tubular and composed of plastic.

26. The food waste disposer of claim 24, wherein:

the first rigid portion comprises a first flanged end, and the first connection portion comprises a connection member disposing on the first rigid portion, the connection member attaching to the discharge outlet and engaging the first flanged end.

27. The food waste disposer of claim 24, wherein the first rigid portion is integrally molded to the first end of the isolation portion.

28. The food waste disposer of claim 24, wherein the first rigid portion comprises a second flanged end, the second flanged end engaging a recess defined in the passage of the isolation portion.

29. The food waste disposer of claim 24, wherein the first connection portion comprises a first clamp device attaching an end of the first rigid portion to the first end of the isolation portion.

30. The food waste disposer of claim 20, wherein the second connection portion comprises a second rigid portion coupled to the second end of the isolation portion.

31. The food waste disposer of claim 30, wherein the second rigid portion is integrally molded to the second end of the isolation portion.

32. The food waste disposer of claim 30, wherein the second rigid portion comprises a flanged end, the flanged end engaging a recess defined in the passage of the isolation portion.

33. The food waste disposer of claim 30, wherein the second connection portion comprises a second clamp device attaching an end of the second rigid portion to the second end of the isolation portion.

34. The food waste disposer of claim 20, wherein:

the first connection portion comprises a first rigid portion coupled to the first end of the isolation portion, and the second connection portion comprises a second rigid portion coupled to the second end of the isolation portion.

35. A food waste disposer connectable to a waste line, comprising:

a discharge outlet; and an assembly for communicating waste from the discharge outlet to the waste line, comprising:

an isolation portion being at least partially flexible for isolating vibration of the disposer, the isolation portion comprising a substantially annular member having an inner dimension and an outer dimension, a first connection the isolation portion to the discharge outlet, the first connection portion comprising a rigid portion movably disposing in the substantially annular member and engaging the inner dimension, and a second connection portion for connecting the outer dimension of the isolation portion to the waste line.

36. The food waste disposer of claim 35, wherein the rigid portion comprises a rim adjacent the inner dimension.

37. The food waste disposer of claim 35, wherein the second connection portion comprises a threaded member integrally molded to the outer dimension and capable of threading onto the waste line.

* * * * *